United States Patent [19]

Bryant

[11] 4,015,453

[45] Apr. 5, 1977

[54] DYE PAN MOUNTING FOR APPARATUS FOR MULTI-COLOR DYEING OF YARN ENDS

[75] Inventor: Clifford Aldene Bryant, Dalton, Ga.

[73] Assignee: West Point Pepperell, Inc., West Point, Ga.

[22] Filed: Feb. 26, 1976

[21] Appl. No.: 661,569

[52] U.S. Cl. ..... 68/202; 101/425; 118/258

[51] Int. Cl.[2] ..... D06B 1/14; D06B 23/30

[58] Field of Search ..... 68/202, 203; 118/258, 118/259; 101/363, 364, 425, 178

[56] References Cited

UNITED STATES PATENTS

| | | | |
|---|---|---|---|
| 2,915,038 | 12/1959 | Wallenberg | 118/258 X |
| 3,227,078 | 1/1966 | Johnson | 101/178 |
| 3,397,675 | 8/1968 | De Ligt | 118/258 |
| 3,747,561 | 7/1973 | Helm | 118/258 X |

*Primary Examiner*—Philip R. Coe
*Attorney, Agent, or Firm*—Davis, Hoxie, Faithfull & Hapgood

[57] ABSTRACT

A series of dye troughs or pans are located in a transverse parallel arrangement along the length of apparatus for dyeing parallel yarn ends. Each pan is pivotally mounted on an axis parallel to and eccentric with respect to the horizontal gravitational axis of the pan so that the pan will rotate downwardly when released, for cleaning or repair. Dye rolls are mounted within the pans and driven by gears which automatically engage and disengage with driving means as the pan is let down and restored to normal operational position.

11 Claims, 4 Drawing Figures

DYE PAN MOUNTING FOR APPARATUS FOR MULTI-COLOR DYEING OF YARN ENDS

This invention relates to improvements in apparatus for selective multi-color dyeing of individual yarns along their lengths, from which will be produced a predetermined complex design in a carpet. More particularly the invention relates to improved means for mounting dye troughs or pans from the framework of the apparatus so that they can be tilted for cleaning and repair of their interiors and elements such as dye pick-up rolls mounted therein.

One object is to provide a mounting for a dye pan in apparatus of the aforesaid type which will not require bodily movement or removal in order to make repairs or for cleaning.

Another object of the invention is to provide a tiltable or pivotal mounting for dye pans in apparatus of the aforesaid type to facilitate cleaning and repair work.

Another object is to provide for dye pick-up rolls in the pans and driving means therefor which will automatically engage and disengage as the pans are moved for cleaning or repair.

Other objects and advantages will become apparent as the invention is described in connection with the drawings.

PRIOR ART

In apparatus prior to this invention, such, for example, as in copending U.S. Pat. application Ser. No. 603,930 of Bartenfeld, Bryant and Newman, filed Aug. 12, 1975, a series of dye troughs positioned transversely along the length of the machine are mounted in such a way that each trough can be removed bodily with its supporting structure by pulling or sliding along the floor sideways from the apparatus. Whilst such an arrangement is entirely satisfactory for apparatus of certain widths and capabilities, it presents some disadvantages and difficulties in apparatus for dyeing yarns and making carpets on wide widths such as 12 or 15 feet. To be able to remove a trough laterally of the machine, a clear space must be made available; and the bulk and weight poses handling problems; and the troughs were hard to clean.

SUMMARY DESCRIPTION OF THE INVENTION

According to the present invention, a series of dye troughs (herein called pans) are located in a transverse parallel arrangement along the length of apparatus for dyeing parallel yarn ends.

Each trough or pan is mounted on a pivotal axis running lengthwise of the pan and located in parallel to, and eccentrically with respect to, the horizontal gravitational axis of the pan so that the pan is normally biased to rotate downwardly about its pivotal axis, being held up while the machine is in operation by bolts or other securing means. Bearings mounted within the pans support dye rolls which move as a unit with the pans when the latter are let down about their pivots. Driving gears for the dye rolls automatically become disengaged as the pan is let down, and likewise automatically reengage when the pan is restored to normal elevated operational position.

DETAILED DESCRIPTION OF THE INVENTION

Figure 1:
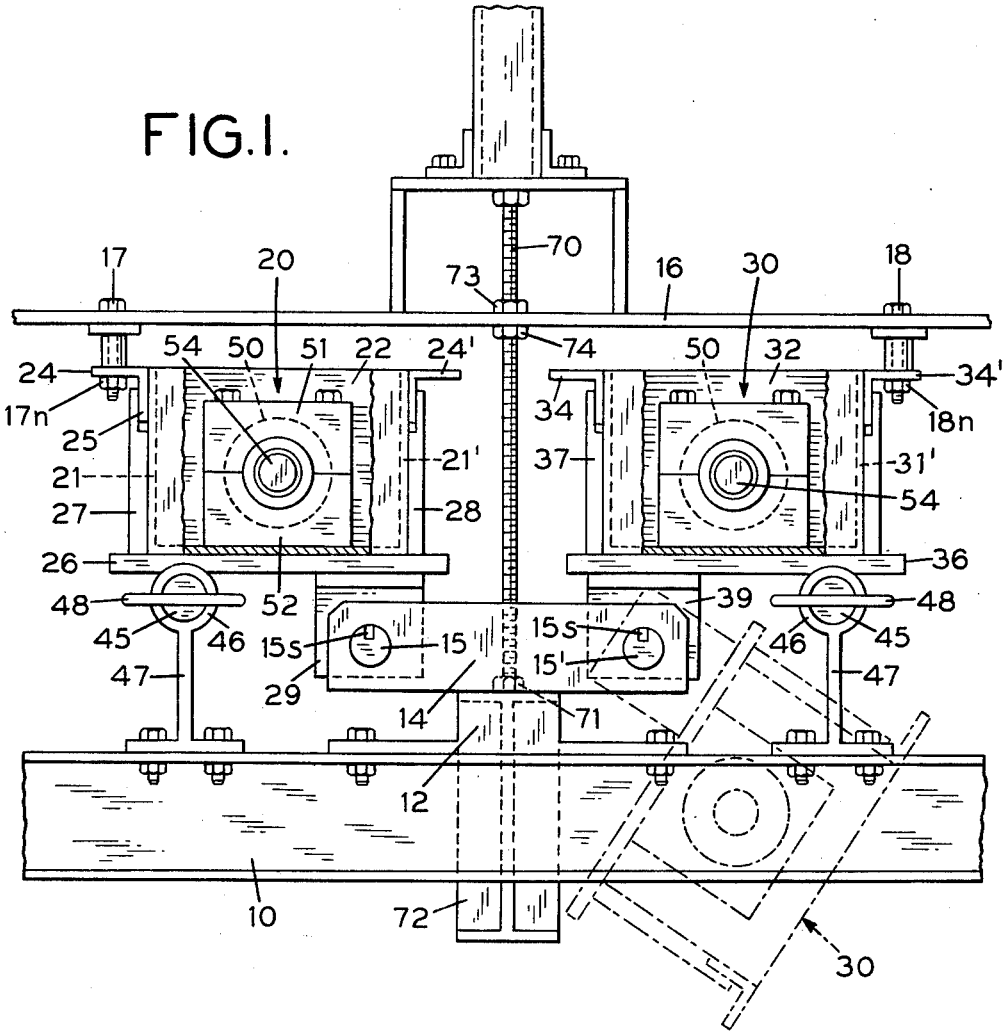
FIG. 1 is an end elevation view of apparatus embodying the improved pan mounting according to the invention.

Referring to the drawings, the invention is illustrated as used with apparatus for selective multicolor dyeing of a bank or sheet of individual yarn ends preparatory to producing therefrom a predetermined complex design in a tufted carpet, such as is disclosed in said application Ser. No. 603,930. Only two dye pans, designated generally by numerals 20 and 30 are shown here, since the present improvement is not concerned with their number but is concerned with improvements in their mounting and associated structure.

The framework of the machine includes longitudinal and transverse beams. At one side, a bearing block support member 12 is connected to a longitudinal beam 10 and supports a bearing block member 14. At the other side, a similar bearing block 14 is mounted on the transverse beam. The bearing blocks 14 provide bearings for horizontal pivot shafts 15, 15' at opposite ends thereof. Pans designated generally by the numerals 20 and 30 are pivotally supported from said shafts 15, 15' by means of right angle bracket members 29, 39 located at each end of the pans. The brackets are secured to the bottom surfaces 26, 36 of U-shaped cradle members within which are seated the pans 20 and 30. There are at least two cradles for each pan, located near each end of the pan.

Each pan (referring for convenience to the left pan 20 in FIG. 1 or upper pan in FIG. 2) has parallel end plates 22, 22' extending lengthwise of the machine and perpendicularly upward from the end edges of a bottom plate 23. Parallel side plates 21, 21' extending transversely of the machine, abut and connect the end plates 22, 22', and abut and are connected to the bottom plate 23 at their respective edges.

Holding the pans in horizontal assembled position are adjustment-and-securing bolts 17, 18, which extend downwardly from longitudinal beams 16, 16' located over the pans, being part of the machine framework. These bolts then screw into nuts **17*n*, 18*n* welded to flanges 24, 34' then run along the upper edges of each of the side plates 21 and 31' of the pans 20 and 30. These flanges may conveniently be parts of angle irons 25 welded to the upper exterior edges of the sides of the pans, thus providing stiffness and strength to the pans. Similar angle irons 24', 34 are welded to the opposite edges of the pans 20, 30.**

Figure 2:
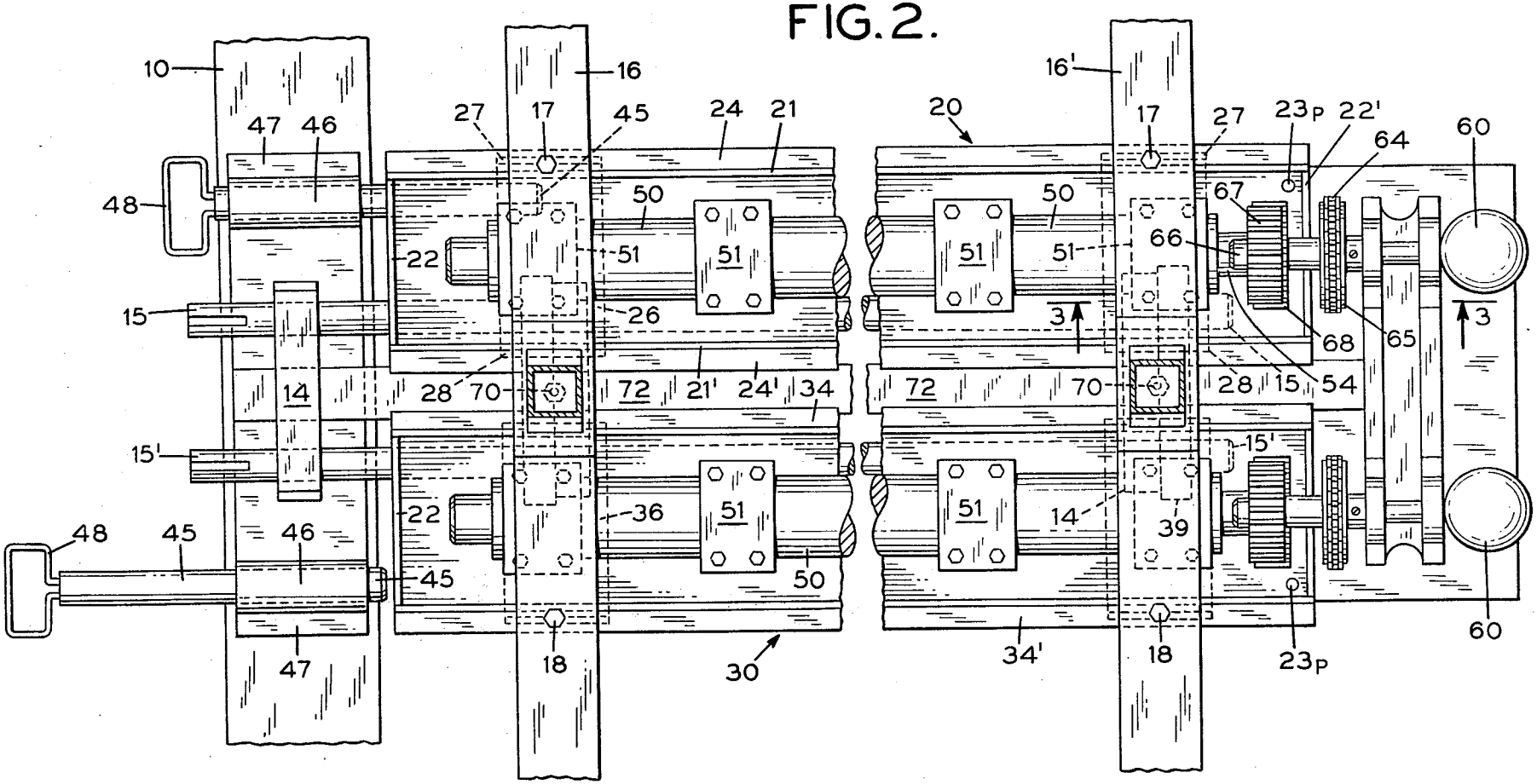
FIG. 2 is a plan view of apparatus of FIG. 1 with parts omitted for clarity.

The pivoted support shafts 15, 15' and brackets 29, 39 are located near the planes of the adjacent sides 28, 37 of the cradles so that when the securing bolts 17, 18 are removed, the pans can pivot downwardly (in counterclockwise and clockwise directions, respectively, in FIG. 1) into positions convenient for servicing and cleaning. This avoids the necessity of removing the pans in an operation which would otherwise be timeconsuming and awkward and would require additional floor space and area for or around the machine.

Figure 4:
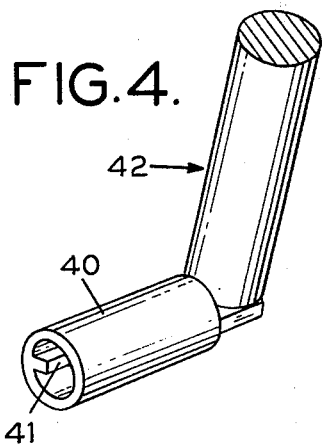
FIG. 4 is a perspective view, partly broken away, of the handle used in lowering the pans.

To facilitate pivoting of the pans, a removable handle or lever member 42 (FIG. 4) is provided, which has at one end a cylindrical hollow socket portion 40 which is adapted to be slid axially onto the end of the shafts 15, 15'. Within and running lengthwise of the socket portion is a key 41 which is adapted to be received in a spline or groove 15s cut lengthwise into the periphery of the shafts 15, 15' at their ends.

Whenever the just-described handle or lever arrangement is employed, it is necessary that the pivot shafts 15, 15' be keyed to their respective brackets 29, 39. It will be understood, however, that other means of controlling the pivoting may be employed and that in some cases the shafts need not be pivoted to the brackets nor turn as the pans pivot between lower and upper positions.

Within each pan is mounted a roll 50 which picks up the dye and is contacted from time to time by the yarns (not shown) as their plungers (not shown) are actuated according to the pattern control mechanism disclosed in said application Ser. No. 603,930.

The roll 50 is supported at spaced points along its length by pairs of upper and lower bearing blocks 51 and 52 which are bolted together and more mounted on the bottom of the pan. Unbolting of the blocks and removal of the upper block of each pair enables the roll to be removed and replaced whenever desired.

When apparatus is designed to make widths of carpet with several laterally spaced pattern repeats, the length of the roll may be as much as 15' long. Advantageously the roll is provided with a plurality of sections of full diameter, between which sections 54 of the shaft of less diameter are supported by the aforesaid bearings.

As the pan (20, for example) is tilted downwardly about its axis 15 (as shown in broken lines at the right side of FIG. 2), the roll within it likewise moves about the axis of the pin and becomes available for cleaning or service. Preferably the pans are pivotable at least 90°, or more, so that their interiors will face approximately vertically and will be freely and readily available for cleaning.

The pans may be emptied into a drain pipe by removal of a plug 23*p* in the bottom at one or in any other convenient way, before the pan is readied for tilting.

To hold the pan momentarily in horizontal position during and temporarily after removal of the securing bolts 17 and 18, a horizontal peg shaft or eccentric pin 45 is provided adjacent one end of each pan, being mounted for axial sliding, horizontally, in a cylindrical bearing 46 supported from the machine frame 10 on a web 47. A loop 48 is provided as a handle on the outer end of the pin 45 to facilitate manual sliding to and fro, when it is desired either to insert the end of the pin 45 below the pan in the path of pan movement to hold the pan or, alternatively, to withdraw the pin, so as to free the pan for downward pivoting.

Figure 3:
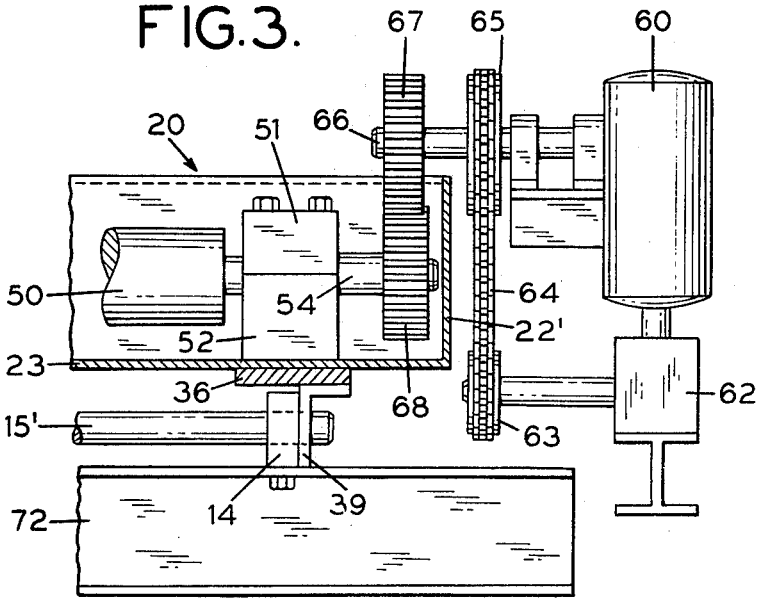
FIG. 3 is a fragmentary elevation view partly broken away of the drive mechanism and one end of a pan of the embodiment of the invention shown in FIGS. 1 and 2.

Referring to FIG. 3, rotation of the dye pick-up rolls is caused by gearing driven by an electric motor 60 through a conventional reduction gear box, shown diagrammatically at 62. The motor 60 and reduction gearing 62 are supported from the machine frame by convenient conventional means; and they drive an output gear 63 around which is trained a chain 64 connecting with a narrow gear 65 on a shaft 66 which extends over the end wall 22 of the pan and is mounted pivotally on the machine frame. A wide drive gear 67 is mounted on said extending end of shaft 66 and is positioned above and inwardly of the end of the pan in position to mesh with a similar driven gear 68 mounted on the end of roll shaft 54 when the pan is in place and properly held by the securing bolt 17.

When the pan is unbolted and is pivoted downwardly (see broken line position in FIG. 1), the gears 67 and 68 will automatically and easily disengage from each other. Conversely, when the pan is restored to horizontal position by upward tilting, the gears 67 and 68 will become easily reengaged.

The different colored dyes may be let into the several pans through pipes controlled manually by valves at the start and may be maintained manually or automatically at predetermined desired level.

To provide strength and rigidity of the structure and adjustment for leveling of the pans, vertical externally screw-threaded posts 70 are provided near the ends of the pans 20 and 30 and between them. These posts are mounted vertically on an I-beam 72 which runs parallel to the pans and at a lower level a nut 71 on the lower end of the post is welded to the I-beam 72. The post passes through the upper beam 16 which may be located at the proper height on the post by adjustment of nuts 73, 74 on the post above and below the upper beam 16 so as to locate the beam at the desired height. Since the pans are secured to the beam 16 by bolts 17 and 18, they will be leveled as the adjustment is completed. Likewise, all yarn moving implements (not shown) of the dyeing apparatus which are carried by the structure on the beams 16 will be supported from the I-beam 72 and bottom framework, strengthening and improving the rigidity of the apparatus.

Many modifications within the scope of the invention will occur to those skilled in the art. Therefore, the invention is not limited to the specific form illustrated.

We claim:

1. In a machine for selective dyeing of yarns in a sheet thereof wherein the yarn sheet passes over dye-pick-up rolls, a receptacle having greater length than width and adapted to hold dye, fixed supporting framework, securing means adjacent an edge of said receptacle supporting said receptacle from said framework in dye-holding position, a dye-pick-up roll positioned within said receptacle and adapted to be engaged by passing yarns, pivot means supporting said receptacle and having an axis running lengthwise of said receptacle and being supported from said framework, the axis of said pivot means being parallel in a lengthwise direction to said receptacle and positioned adjacent one wall of said receptacle to enable tilting of said receptacle when freed from said supporting means to cause its interior to face approximately vertically.

2. In a machine for selective dyeing of yarns in a sheet thereof wherein the yarn sheet passes over dye-pick-up rolls, supporting framework, a receptacle having greater length than width and adapted to hold dye, a dye-pick-up roll positioned within said receptacle and adapted to be engaged by passing yarns, pivot means supporting said receptacle and having an axis running lengthwise of said receptacle and being supported from said framework, the axis of said pivot means being parallel in a lengthwise direction to said receptacle and positioned to guide pivotal movement of said receptacle when freed into a position with its interior facing approximately vertically, means supported from said framework to maintain said receptacle in dye-retaining position, and a second pivotally mounted receptacle and dye-pick-up roll as claimed above mounted adjacent the first, the pivot means for said second receptacle being positioned opposite to the first so that the pivoting of the second receptacle is opposite in direction to the first.

3. A machine as claimed in claim 2 having a bearing block at each end of the pivot means, each of said bearing blocks supporting both of said pivot means.

4. A machine as claimed in claim 1 having cradle means supporting said receptacle, and bracket means adjacent each end of said receptacle and connected to said cradle means adjacent a lower edge of said receptacle, said pivot means passing through said bracket means.

5. In a machine for selective dyeing of yarns in a sheet thereof wherein the yarn sheet passes over dye-pick-up rolls, a receptacle having greater length than width and adapted to hold dye, supporting framework, a dye-pick-up roll positioned within said receptacle and adapted to be engaged by passing yarns, bearing means mounted within said receptacle to pivotally support said roll whereby said roll is movable with said receptacle as it pivots, pivot means supporting said receptacle and having an axis running lengthwise of said receptacle and being supported from said framework, the axis of said pivot means being parallel in a lengthwise direction to said receptacle amd positioned to guide pivotal movement of said receptacle when freed into a position with its interior facing approximately vertically, driving means on said framework, and means within said receptacle and movable with said roll driven by said driving means and automatically disconnecting from and connecting with said driving means as said receptacle is pivoted.

6. A machine as claimed in claim 5 in which said driving and driven means are gears.

7. In a machine for selective dyeing of yarns in a sheet thereof wherein the yarn sheet passes over dye-pick-up rolls a receptacle having greater length than width and adapted to hold dye fixed supporting framework, a dye-pick-up roll positioned within said receptacle and adapted to be engaged by passing yarns, pivot means supporting said receptacle and having an axis running lengthwise of said receptacle and being supported from said framework, the axis of said pivot means being parallel in a lengthwise direction to said receptacle, and positioned to guide pivoted movement of said receptacle when freed into a position with its interior facing approximately vertically, securing means on said framework connectable with said receptacle to maintain it in non-tilted horizontal position, and supplemental supporting means mounted on said framework movable into a position of engagement with said receptacle to hold said receptacle in non-tilted position when said securing means is disconnected.

8. A machine as claimed in claim 7 wherein said supplemental supporting means comprises a pin slidable into and out of a position beneath said receptacle.

9. In a machine for selective dyeing of yarns in a sheet thereof wherein the yarn sheet passes over dye-pick-up rolls, a receptacle having greater length than width and adapted to hold dye, supporting framework, a dye-pick-up roll positioned within said receptacle and adapted to be engaged by passing yarns, pivot means supporting said receptacle and having an axis running lengthwise of said receptacle and being supported from said framework, the axis of said pivot means being parallel in a lengthwise direction to said receptacle and positioned to guide pivotal movement of said receptacle when freed into a position with its interior facing approximately vertically, said pivot means comprising a shaft secured to said receptacle for movement therewith, and a lever connectable with said shaft, and means on the shaft engageable by said lever to control rotation of said shaft as said lever is moved.

10. In a machine for selective dyeing of yarns in a sheet thereof wherein the yarn sheet passes over dye-pick-up rolls, a receptacle having greater length than width and adapted to hold dye, supporting framework, a dye-pick-up roll positioned with said receptacle and adapted to be engaged by passing yarns, bearing means mounted within said receptacle to pivotally support said roll whereby said roll is movable with said receptacle as it pivots, said bearing means having two parts, means securing said parts together but releasable to permit removal of said roll in either horizontal or tilted position of said receptacle, pivot means supporting said receptacle and having an axis running lengthwise of said receptacle and being supported from said framework, the axis of said pivot means being parallel in a lengthwise direction to said receptacle and positioned to guide pivotal movement of said receptacle when freed into a position with its interior facing approximately vertically.

11. In a machine as claimed in claim 1 wherein the supporting framework includes beam means above said receptacle, and said securing means supports said receptacle from said beam means, and said pivot means is positioned adjacent a lower edge of said receptacle so as to cause said receptacle to tilt downwardly to occupy space under its position when secured in dye-holding position, in order to conserve floor space.

* * * * *